US005704166A

United States Patent [19]

Tam et al.

[11] Patent Number: 5,704,166

[45] Date of Patent: Jan. 6, 1998

[54] WINDOW ASSEMBLY WITH SAFETY CATCH FOR VERTICALLY SLIDING SASH

[75] Inventors: Terry Tam, Markham; Mirko Kovac, Woodbridge; Don Thomson, Georgetown, all of Canada

[73] Assignee: Alumicor Limited, Rexdale, Canada

[21] Appl. No.: 713,362

[22] Filed: Sep. 13, 1996

[51] Int. Cl.[6] ..... E05D 13/00

[52] U.S. Cl. ..... 49/322

[58] Field of Search ..... 49/322, 449

[56] References Cited

U.S. PATENT DOCUMENTS

| | | | |
|---|---|---|---|
| 4,080,757 | 3/1978 | Westerman | 49/322 |
| 4,604,828 | 8/1986 | Baarse | 49/322 |
| 4,696,375 | 9/1987 | Matthews et al. | 49/322 X |
| 4,914,862 | 4/1990 | Gregory | 49/322 |
| 4,956,938 | 9/1990 | DeMent | 49/322 X |
| 5,291,686 | 3/1994 | Sears et al. | 49/322 |

*Primary Examiner*—Jerry Redman

[57] ABSTRACT

A window assembly with a safety catch comprises a manually movable window sash which normally slides between a raised and a fully lowered position within a surrounding window frame. A weight is connected to the sash by a cable which counter-balances weight of the sash. The safety catch prevents downward falling of the sash to the fully lowered position in the event of breakage of the cable. The safety catch comprises a sash block spaced below the weight and clear of the sash when the cable is intact and the weight is positioned to fall if released from the sash to move the sash block to a blocking position which holds the sash above its fully lowered position.

6 Claims, 3 Drawing Sheets

WINDOW ASSEMBLY WITH SAFETY CATCH FOR VERTICALLY SLIDING SASH

FIELD OF THE INVENTION

The present invention relates to a window assembly having a manually movable sash counter-balanced by a weight held to the sash by a cable and a catch which prevents falling of the sash to its fully lowered position in the event of the cable breaking and releasing the counter-balancing weight.

BACKGROUND OF THE INVENTION

Fast food outlets are becoming more and more popular. The food served at a fast food outlet is typically passed to the customer through a vertically sliding window. The window is raised for both the transfer of cash and the product and is lowered after the transfer has been made. The operator must be able to get the window up and down as quickly as possible. In the past, window movement has been accomplished manually, however with the frequency that these windows are used, this becomes very tiring on the operator because of the force required to both lift and lower the window.

More recently, many fast food windows have become automated through the use of a motor control for raising and lowering the window. However, the motors are subject to break down and can jamb the window from either moving up or moving down.

There are some old style windows which are relatively freely operated with very little manual assistance required. These windows use a weight as a counter-balance for the weight of the sliding sash and the operator needs only to overcome the inertia of the sash in its fixed position in order to either raise or lower the sash.

There are potential problems however with the above relatively freely movable window in that should the weight release from the sash, the sash could well injure the operator if the operator has his or her hands positioned beneath the falling sash.

SUMMARY OF THE INVENTION

The present invention provides a window assembly which overcomes all of the problems raised above. More particularly, the window assembly in accordance with the present invention comprises a manually operated sash which normally slides between a raised and a fully lowered position within a surrounding frame, a weight connected to and counter-balancing weight of the sash and safety means which prevents downward falling of the sash to the fully lowered position in the event of breakage of the cable.

The safety means comprises a sash block spaced directly below the weight and being clear of the sash when the cable is intact and the weight being positioned to fall if released from the sash to move the sash block to a blocking position which holds the sash above the fully lowered position.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
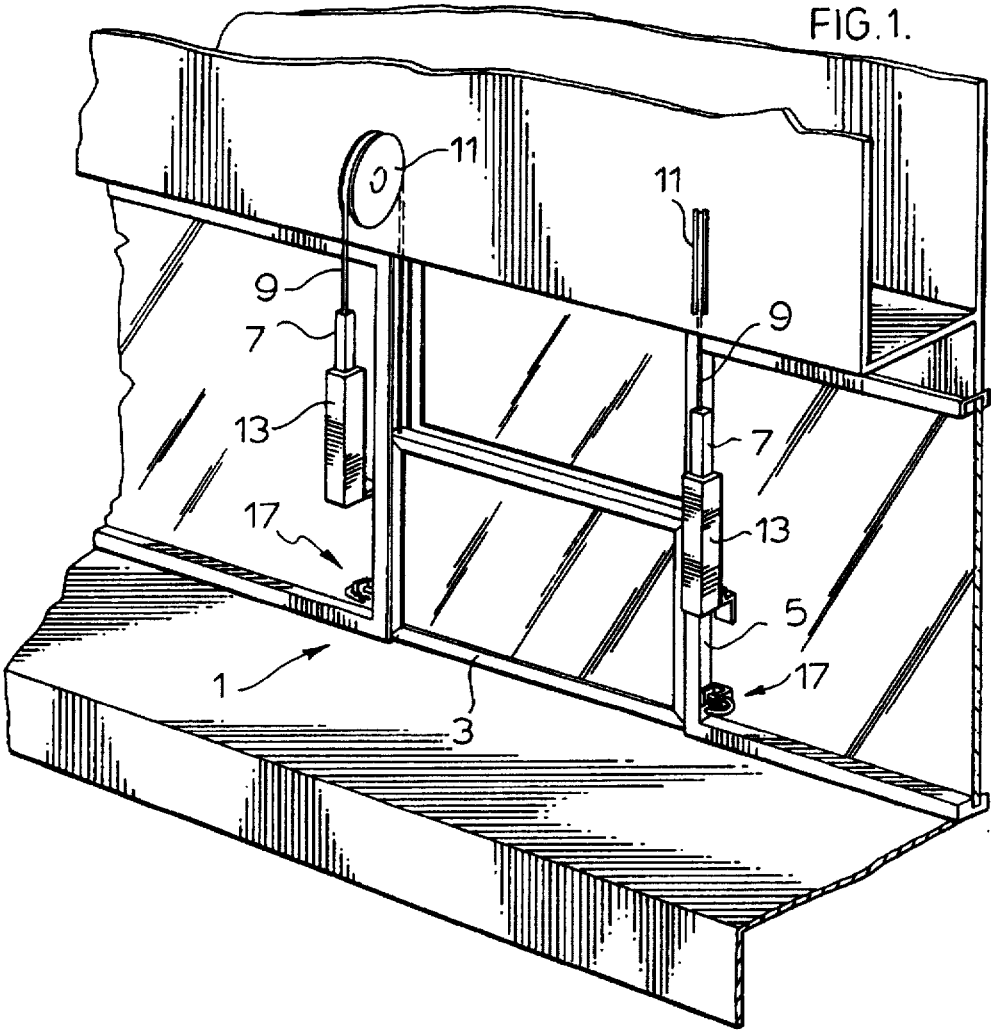
FIG. 1 is a perspective view of a window assembly according to a preferred embodiment of the present invention.

FIG. 1 shows a window assembly generally indicated at 1 which is well suited for use in a fast food outlet or other similar locations. This assembly comprises a manually operated window sash 3 which slides vertically within its surrounding frame 5. The sash is counter-balanced by a pair of weights 7, one to either side of the sash. These weights are connected back to the sash by means of cables 9 wrapping around pulleys 11. The weights slide through vertical guides 13. A safety catch generally indicated at 17 is provided directly below each of the guides 13.

The weights 7 and the friction of the cables 9 around the pulleys 11 provide just the right amount of counter-balancing to hold the sash or window in a set position. The sash can be moved either up or down from its set position with only a very slight manual assistance from the window operator.

Figure 2:
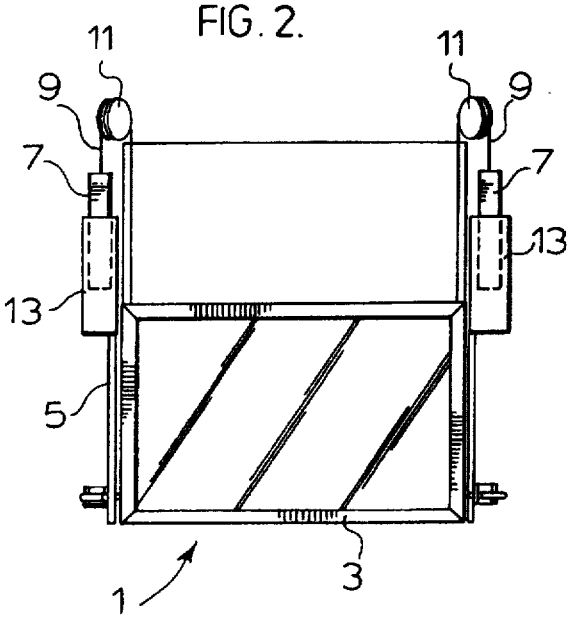
FIG. 2 is a rear view of the assembly of FIG. 1 with the sash in its fully lowered position.
Figure 3:
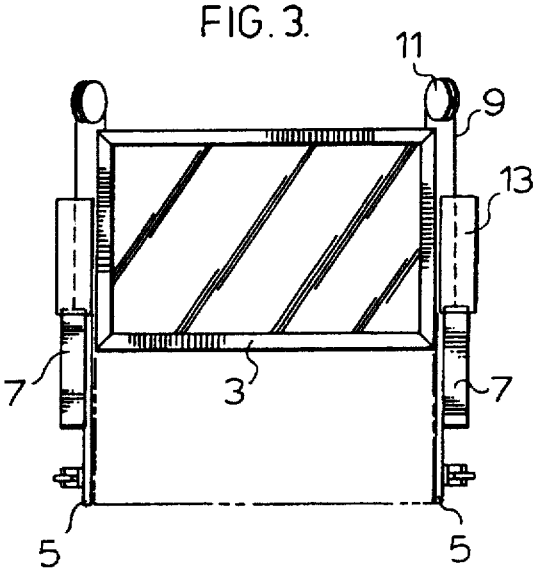
FIG. 3 is a view similar to FIG. 2 with the sash in its most raised position.

FIG. 2 of the drawings shows the window in its lowermost position while FIG. 3 shows the window in its uppermost position. Here it should be noted that even when the window is in its uppermost position, the weights 7, when in their normal lowermost position, are located spaced above each of the catches 17. Therefore, the weights when connected to the sash through the cables do not interfere with the catches in any position of their normal travel.

The purpose of the catches 17 is to ensure that if either of the weights 7 releases from the sash because of cable breakage, the sash without proper counter-balancing will not fall to its lowermost position of FIG. 2. As will be seen in FIGS. 7 and 8 of the drawings when the catch is activated it holds the sash such that there is a gap G beneath the sash so that an operator does not get his or her hands hurt by the falling sash. The details of the window catch are seen having reference to FIG. 4 of the drawings. The catch comprises a bracket 19 secured to the frame 5 and offset from the path of movement of weight 7. A pin 21 projects through the bracket 19 and that pin includes first and second legs 23 and 25. Pin 21 is secured to the frame 5 by means of a spring 27.

Figure 4:
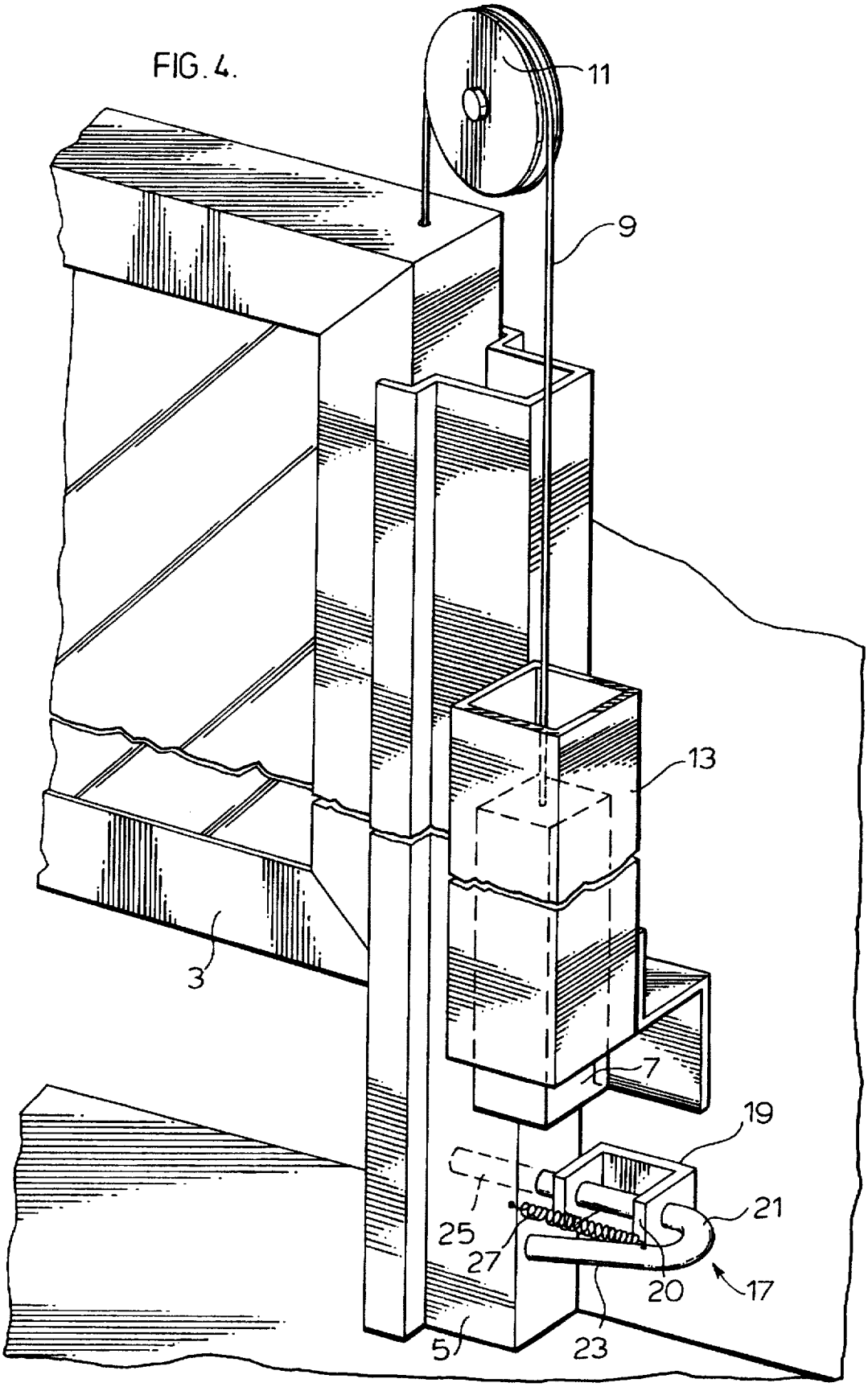
FIG. 4 is an enlarged perspective view of one side of the window assembly in the FIG. 3 position.
Figure 5:
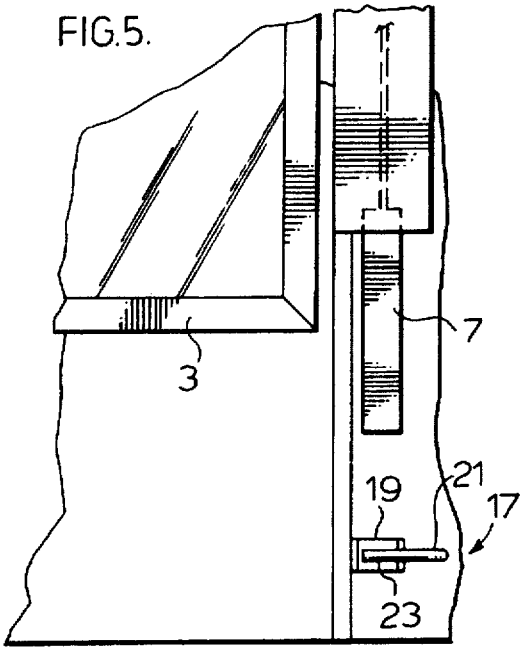
FIG. 5 is an enlarged rear view of one side of the assembly of FIG. 3 with the weight connecting cable intact.

Leg 23 of pin 21 normally sits on a keeper or arm 20 of the bracket 19 which holds the pin against the pressure of spring 27 in the FIGS. 4 and 5 position where the leg 25 of the pin is retracted within the frame 5 relative to the sash 3. In this position, the arm 23 of the pin sits directly below weight 7.

Figure 6:
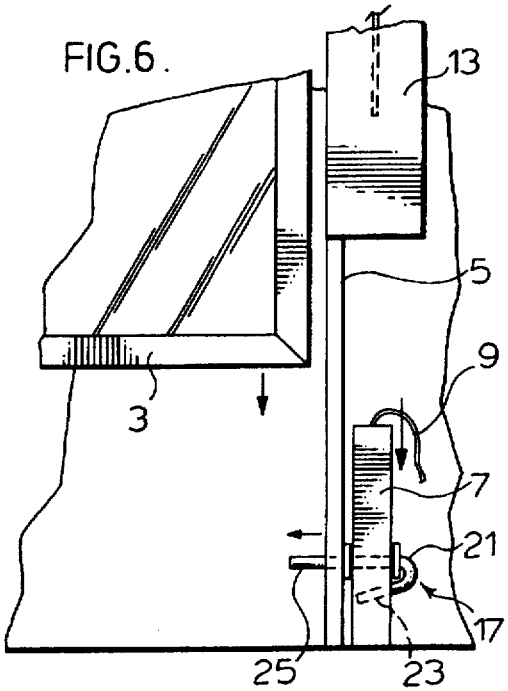
FIG. 6 is a view similar to FIG. 5 but with a broken cable.

In the event that the cable 9 snaps and releases the weight 7 as shown in FIG. 6 of the drawing, the weight falls down striking the leg 23 on pin 21 causing the pin to rotate in the bracket 19 and pushing the leg 23 off of the keeper 20 of the bracket. Once the leg 23 of the pin has released from the keeper, spring 27 pulls the pin to the FIG. 6 position where the leg 25 of the pin projects through frame 5 into the path of the falling sash 3. Here it should be noted that the weight 7 always hangs down farther than the sash and therefore will fall to the FIG. 6 position before the sash has a chance to reach the same position. Accordingly, the pin end 25 is in its sash blocking position before the sash can pass by the pin.

Figure 7:
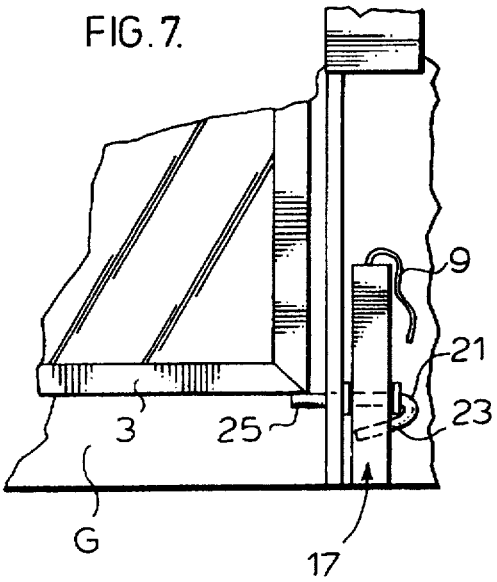
FIG. 7 shows the arrangement of FIG. 6 with the window blocked from falling to its most lowered position.
Figure 8:
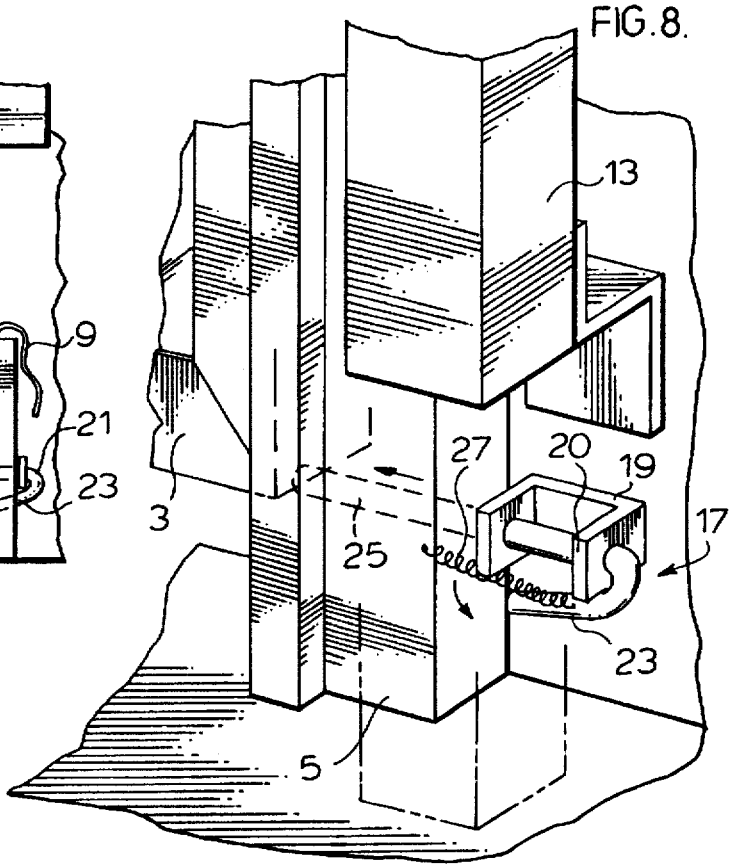
FIG. 8 is an enlarged perspective view of the window assembly with the sash in the FIG. 7 position.

FIGS. 7 and 8 as earlier described show the pin in its sash blocking position with the sash falling as far as allowed by the pin and above the lowermost position that that the sash is normally allowed to move to when the cables holding the weights on either side of the sash remain intact.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A window assembly comprising a manually operated window sash which normally slides between a raised and a fully lowered position within a surrounding window frame, a weight connected to said sash by a cable counter-balancing weight of the sash and safety means which prevents downward falling of said sash to the fully lowered position in the event of breakage of said cable, said safety means comprising a sash block spaced below said weight and being clear of said sash when said cable is intact, and said weight being positioned to fall when released from said sash and said weight moves said sash block to a blocking position holding said sash above the fully lowered position.

2. A window assembly as claimed in claim 1, wherein a first part of said sash block is located in line directly beneath said weight.

3. A window assembly as claimed in claim 2, wherein said weight slides within a weight guide and said sash block is mounted to said frame with said first part of said sash block being located below said weight in said weight guide and a second part of said sash block is adapted to move through said frame beneath said sash when said first part of said sash block is impacted by said weight.

4. A window assembly as claimed in claim 3, wherein said safety means comprises a keeper and a spring, said sash block comprising a pin to which said spring is attached, said keeper normally holding said pin against pressure from said spring away from the blocking position, and said pin being movable off of said keeper by said weight enabling said spring to pull the pin to the blocking position.

5. A window assembly as claimed in claim 4, wherein said pin turns downwardly to move off of said keeper and slides inwardly from said keeper to the blocking position.

6. A window assembly as claimed in claim 1, wherein said cable passes around a pulley between said weight and said sash.

* * * * *